United States Patent [19]

Lindskog et al.

[11] 4,376,245

[45] Mar. 8, 1983

[54] ELECTRICAL HEATING ELEMENT

[75] Inventors: Nils Lindskog; Ingvar Oderstig; Lars Berg, all of Hallstahammar, Sweden

[73] Assignee: Bulten-Kanthal AB, Hallstahammar, Sweden

[21] Appl. No.: 229,609

[22] Filed: Jan. 28, 1981

[30] Foreign Application Priority Data

Feb. 6, 1980 [SE] Sweden ..... 8000970

[51] Int. Cl.[3] ..... H05B 3/10

[52] U.S. Cl. ..... 219/552; 75/124; 75/126 G; 219/541; 219/544; 338/238

[58] Field of Search ..... 219/270, 541, 544, 552, 219/553; 75/122, 124, 126 R, 126 G, 176, 129; 338/238, 242; 136/236 R, 239

[56] References Cited

U.S. PATENT DOCUMENTS

| | | | |
|---|---|---|---|
| 3,027,252 | 3/1962 | McGurty et al. | 75/126 R |
| 3,298,826 | 1/1967 | Wukusick | 75/126 G |
| 3,369,209 | 2/1968 | Edwin et al. | 338/238 |
| 4,244,736 | 1/1981 | Day | 75/129 |

FOREIGN PATENT DOCUMENTS 7803588 3/1978 Sweden .

*Primary Examiner*—Volodymyr Y. Mayewsky
*Attorney, Agent, or Firm*—Pollock, Vande Sande & Priddy

[57] ABSTRACT

An electrical tubular element with an outer, metallic casing (1) surrounding a resistor element (2) of a Fe-Cr-Al alloy embedded in an insulating material (3), is given improved durability by adding to the resistor alloy Y, Hf, Sc or one or more lanthanides in an amount of 0.01–1 percent by weight.

4 Claims, 1 Drawing Figure

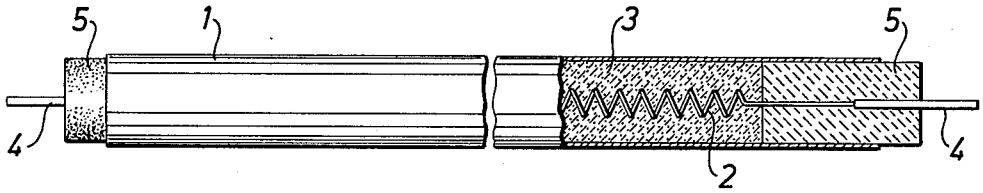
5
1
3
5
4
2
4

ELECTRICAL HEATING ELEMENT

This invention relates to an electrical heating element with an outer metallic casing surrounding a resistor element embedded in an insulating material. The invention especially relates to a heating element in which the resistor element is an Fe-Cr-Al alloy embedded in a mass of magnesium oxide.

Heating elements of this type, known as tubular elements, are used in domestic appliances of different kinds, as e.g., as table ranges, irons and ovens. The tubular elements must then resist an operating temperature of about 800° C. and in certain applications just above 900° C. The temperature in the resistor wire will then be 100°-200° C. higher.

For the manufacture of a tubular element, a coil of a resistor wire is inserted into a tube of a suitable heat-resistant material which is vertically placed, and magnesium dioxide powder is added and vibrated down as an electic insulation around the coil. The tube is thereafter compressed in such a manner that its diameter is decreased, and is then optionally sealed at the ends, being provided with terminal connectors. Even if the tube ends are sealed, there will in practice, at a high operating temperature, be a certain permeability for air and steam.

When heating an alloy of a Fe-Cr-Al type in the presence of oxygen, a protective layer of $Al_2O_3$ is formed on the surface at the operating temperature, preventing diffusion into or out of the alloy.

When the oxygen in the tubular element after some time of use has been consumed, resulting in an important decrease of the oxygen partial pressure, aluminum nitrides are formed instead of oxides, partly on the surface but also inside the material. In this way the alloy will be depleted of aluminum.

These changes in the material bring about the changes in cold and heat resistance. It is known that the cold resistance of the material is proportional to its aluminum content, while the temperature coefficient of the resistance is inversely proportional to the aluminum content. As the aluminum content decreases, a lower cold resistance and higher heat resistance result. Increased heat resistance results in a decreased effect at a constant voltage.

On the market, two types of resistor wire currently being used in tubular elements are (a) Fe-Cr-Al alloys, e.g., Kanthal® DSD ((Fe-22Cr-4.5Al), and (b) Ni-Cr alloys, e.g., Nikrothal® 80 (80Ni-20Cr). In certain applications the Fe-Cr-Al alloys, due to the above mentioned circumstances, show inferior durability and greater variations in cold and heat resistance. Within the respective groups there are alloys of different compositions, alloys with a high Ni content being substantially more expensive than Fe-Cr-Al alloys.

The object of the present invention is to achieve a Fe-Cr-Al alloy which can be used as resistor wire in tubular elements at all normally occurring operating temperatures, and which then fulfills the demands for durability and limited resistance variations.

Fe-Cr-Al alloys containing yttrium are known, e.g., through DE-OS 2 813 569, in which it is stated that alloys of this type show an improved resistance to oxidation and corrosion in air. However, it could not be predicted that these alloys, when used as resistor elements in the oxygen deficient environment arising in a tubular element after some time of use, would result in the improvement achieved according to the invention.

It has now been evidenced that tubular elements of the above stated kind with improved durability at high temperature, can be obtained by utilization of a resistor element of a Fe-Cr-Al alloy also comprising Y, Hf, Sc or one or more lanthanides, in an amount of 0.01-1 percent by weight, preferably 0.1-0.5 percent by weight.

The Fe-Cr-Al alloy according to the invention preferably has the composition 12-25 percent by weight Cr, 3-6 percent by weight Al, 0.01-1 percent by weight Y, the remainder being Fe and minor amounts of other substances, e.g., Si, Mn and Co, known to those skilled in the art, and the usual impurities in a total amount not exceeding 2 percent by weight.

The invention will now be described further below with reference to the following examples and the attached drawing, which shows a lateral view of a tubular element according to the invention, partly in section. The tubular element shown in the single drawing figure comprises an outer casing 1 surrounding a resistor coil 2 embedded in magnesium dioxide powder 3. The resistor coil is connected to terminal connectors 4 and the ends of the element are sealed with end seals 5.

EXAMPLE 1

Tubular elements were manufactured with a resistor wire of Fe-20Cr-5Al-0.1Y with a diameter of 0.4 mm and were compared to identical tubular elements provided with resistor wires comprising an alloy with the composition Fe-22Cr-5Al and an alloy with the composition 80Ni-20Cr.

A current was led through the wire so that the outside of the tubular element was heated to 830° C. during 60 min and thereafter the wire was made currentless for 20 min (cycling according to UL 1030). The variation in cold resistance and heat resistance, respectively, was measured.

This intermittent duty was continued for a considerable time, during which the resistance in the wire in cold and hot state, respectively, was measured at an interval of 500 hours. The following results were obtained.

| | 100 | 500 | 1000 | 1500 | 2000 | 2500 | 3000 |
|---|---|---|---|---|---|---|---|
| | Variation in cold resistance in % after the stated number of hours | | | | | | |
| Fe-22Cr-5Al | −7 | −20 | −21 | −32 | −34 | | |
| Fe-20Cr-5Al-0.1Y | −3 | −6 | −8 | −9 | −10 | −11 | −11 |
| 80Ni-20Cr | — | — | — | — | — | — | — |
| | Variation in heat resistance in % after the stated number of hours | | | | | | |
| Fe-22Cr-5Al | — | +3 | +8 | +16 | +17 | | |
| Fe-20Cr-5Al-0.1Y | — | — | −2 | −1 | −3 | −2 | −2 |
| 80Ni-20Cr | — | +2 | +2 | +3 | +1 | +2 | +2 |

From the foregoing, it is apparent that the cold resistance decreases considerably less for the alloy containing yttrium than for the corresponding alloy without yttrium, while there is no variation in the Ni-Cr alloy. On the other hand, heat resistance increases considerably for the Fe-22Cr-5Al alloy, but is almost unchanged for both the alloy containing yttrium and the Ni-Cr alloy.

EXAMPLE 2

Tubular elements with an outer diameter of 6.5 mm and a total length of 795 mm were manufactured in a conventional manner, using a coil of the above mentioned alloy Fe-20Cr-5Al-0.1Y as a resistor element. The resistor coil was placed in the tube casing Nikrothal ® 20 (Fe-25Cr-20Ni) and was embedded in a mass of MgO powder. The ends of the tubular element were sealed with silicon rubber and were left unsealed, respectively.

The life time of these tubular elements, sealed as well as unsealed, was measured and compared to the durability of tubular elements containing a resistor coil of a Fe-22Cr-5Al alloy and an 80Ni-20Cr alloy, respectively. These tests were made at two different temperatures, 830° C. and 930° C., corresponding to a wire temperature of about 1000° C. and 1100° C., respectively. The tubular elements were cycled according to UL 1030 to rupture, i.e., a current was led through the wire for 60 min and then the wire was cooled for 20 min. The following results were obtained, both test values being stated when a test was performed twice.

| | Life time of tubular element in hours | | |
|---|---|---|---|
| Resistor wire | Ends of element | Surface temp. 830° C. | Surface temp. 930° C. |
| Fe-22Cr-5Al | sealed | 2426 | 704 |
| | unsealed | 790/916 | 330 |
| Fe-20Cr-5Al-0.1Y | sealed | >5200 | 875/1535 |
| | unsealed | >5200 | 650/750 |
| 80Ni-20Cr | sealed | >5200 | 2168 |
| | unsealed | 4820 | 1587 |

The foregoing shows that a tubular element according to the invention at an operating temperature of 830° C. is equivalent to a tubular element with a resistor coil of 80Ni-20Cr. At the higher temperature the tubular element according to the invention is somewhat inferior to the tubular element with the Ni-Cr alloy, but definitely superior to the tubular element with the Fe-Cr-Al alloy.

An examination of the interface between resistor wire and magnesium oxide mass by means of a scanning electron microscope with a micro probe shows that the interlayers look different in the two elements. The examination was made on samples which had been cycled for 60 hours at 930° C. according to UL 1030, after which the cold resistance had decreased 16% for a Fe-Cr-Al alloy and 6% for a Fe-20Cr-5Al-0.1Y alloy.

In the tubular element comprising the Fe-Cr-Al alloy, a continuous AlN-layer had been formed in the surface zone of the wire, which layer was strong and irregular; AlN could also be found as particles in the material. Outside the AlN-layer was a zone of Al, O and Mg. In the element comprising the Fe-20Cr-5Al-0.1Y alloy there was a non-continuous AlN-layer in the surface zone of the wire, and outside this layer a layer of Al, O and Mg which was thicker than in the Fe-Cr-Al alloy.

The tubular element according to the invention accordingly shows improved durability in relation to previously known tubular elements with resistor wires of a Fe-Cr-Al alloy.

We claim:

1. An electrical heating element having an improved durability at a high temperature comprising:

(a) a resistor element in the form of an elongated wire of an alloy which is resistant to nitriding in an oxygen-deficient, nitrogen-containing atmosphere, said resistor element comprising 12–25 percent by weight Cr, 3–6 percent by weight Al, 0.01–1 percent by weight of at least one member of the group consisting of Y, Hf, Sc, and the lanthanides, a minor amount of at least one member selected from the group consisting of Si, Mn, and Co, and the balance Fe;

(b) an insulating material comprising MgO in which said resistor element is embedded; and (c) an outer metallic casing surrounding said insulating material and said resistor element embedded therein.

2. Electrical heating element according to claim 1, wherein said resistor element has the shape of a wire coil.

3. An electrical heating element according to claim 1 wherein the alloy contains 0.01 percent by weight Y.

4. An electrical heating element according to claim 1 wherein said resistor element comprises 20–25 percent by weight Cr, 4–5 percent by weight Al, 0.01–0.5 percent by weight Y, a minor amount of at least one member selected from the group consisting of Si, Mn and Co, and the balance Fe.

* * * * *